US007735465B2

(12) United States Patent
Kunert et al.

(10) Patent No.: US 7,735,465 B2
(45) Date of Patent: Jun. 15, 2010

(54) METHOD FOR OPERATING AN INTERNAL COMBUSTION ENGINE

(75) Inventors: Nils Kunert, Ottenbach (DE); Jan Borchardt, Waiblingen (DE); Andreas Bähner, Weinstadt (DE); Predag Ostojic, Freiberg (DE); Andreas Lingen, Althütte (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 20 days.

(21) Appl. No.: 11/826,153

(22) Filed: Jul. 12, 2007

(65) Prior Publication Data

US 2008/0011271 A1 Jan. 17, 2008

(30) Foreign Application Priority Data

Jul. 13, 2006 (DE) ..... 10 2006 032 474

(51) Int. Cl.
*F02B 75/02* (2006.01)
*F02P 5/00* (2006.01)

(52) U.S. Cl. ..... 123/257; 123/260; 123/406.26

(58) Field of Classification Search ..... 123/73 R, 123/257, 260, 362, 394, 406.12, 406.18, 123/406.26, 406.53, 406.58
See application file for complete search history.

(56) References Cited

U.S. PATENT DOCUMENTS 3,885,720 A * 5/1975 Brennan ..... 123/406.29
5,901,673 A 5/1999 Ishikawa
6,360,724 B1 * 3/2002 Suhre et al. ..... 123/481
6,880,525 B2 * 4/2005 Geyer et al. ..... 123/406.18
7,325,528 B2 * 2/2008 Schieber et al. ..... 123/257
2006/0157006 A1 7/2006 Schieber et al.

OTHER PUBLICATIONS

"101 Harley-Davidson Twin Cam Performance Project; Performance Projects" by Kenna Love, Chris Maida, Mark Zimmerman, Jeff Hackett published by MotorBooks/ MBI publishing Company, 2005 (Love). http://books.google.com/books?id=XgSgJnIqA9sC&pg=PA220&dq=rev+limiter+power&Ir.*

* cited by examiner

*Primary Examiner*—John T Kwon
(74) *Attorney, Agent, or Firm*—Walter Ottesen

(57) ABSTRACT

An internal combustion engine includes a cylinder (2) wherein a combustion chamber (5) is formed. The engine also includes devices for metering fuel and combustion air as well as an ignition device for igniting the mixture in the combustion chamber (5). A method for operating the internal combustion engine provides that fuel and combustion air are supplied to the engine and the mixture is ignited in the combustion chamber (5). The combustion chamber (5) is delimited by a piston (7) which drives a crankshaft (25) rotatably journalled in a crankcase (3). A control is provided which controls the supply of fuel and the ignition of the mixture in the combustion chamber (5). The internal combustion engine is so controlled in at least one operating state that the number of combustions is less than the number of engine cycles in the same time span. To avoid the formation of self ignitions, the operating state is a high rpm range wherein the rpm lies above the rated rpm and below the rpm in a regulating range.

10 Claims, 6 Drawing Sheets

METHOD FOR OPERATING AN INTERNAL COMBUSTION ENGINE

CROSS REFERENCE TO RELATED APPLICATIONS

This application claims priority of German patent application no. 10 2006 032 474.9, filed Jul. 13, 2006, the entire content of which is incorporated herein by reference.

BACKGROUND OF THE INVENTION

A method of the above kind for operating an internal combustion engine is disclosed in United States patent application publication no. US 2006/0157006 A1 (now U.S. Pat. No. 7,325,528) which is incorporated herein by reference and is assigned to the same assignee as the present application.

U.S. Pat. No. 5,901,673 discloses a two-stroke engine wherein fuel is injected into the combustion chamber for each crankshaft revolution in the region of bottom dead center of the piston and the air/fuel mixture, which is formed in the combustion chamber, is ignited in the region of the top dead center of the piston.

United States patent application publication no. US 2006/0157006 A1 (now U.S. Pat. No. 7,325,528) discloses controlling a two-stroke engine in at least one operating state so that the number of combustions is less than the number of revolutions of the crankshaft in the same time interval.

To limit the rpm of an internal combustion engine, U.S. Pat. No. 6,880,525 discloses holding the ignition switch open when exceeding an end rpm in order to suppress an ignition spark over at least one crankshaft revolution. The suppression of the ignition spark is intended to prevent a combustion in the next engine cycle. In this way, a reduction of the rpm can be reached so that the rpm cannot increase uncontrolled beyond a highest rpm.

It has been shown that in internal combustion engines controlled in this manner, a large increase of the rpm from the full load rpm can occur when the load is suddenly reduced. This can, for example, take place in a brushcutter when the filament tears. The sudden uncontrolled increase of the rpm leads to a high load on the component. It has furthermore been shown that the exhaust gas values deteriorate greatly with an uncontrolled increase of the rpm.

SUMMARY OF THE INVENTION

It is an object of the invention to provide a method for operating an internal combustion engine wherein an uncontrolled large increase of the rpm from the full load rpm is avoided.

The method of the invention is for operating an internal combustion engine. The engine includes: a cylinder; a piston mounted in the cylinder to undergo a reciprocating movement along a stroke path between top dead center and bottom dead center during the operation of the engine; the cylinder and the piston conjointly delimiting a combustion chamber; a crankcase connected to the cylinder; a crankshaft rotatably mounted in the crankcase; the piston being connected to the crankshaft for imparting rotational movement to the crankshaft; a device for metering fuel to the engine and a device for supplying air to the engine; an ignition unit for igniting an air/fuel mixture in the combustion chamber; and, a control unit controlling the metering of the fuel and the ignition of the mixture in the combustion chamber; the method comprising the step of controlling the engine in at least one operating state so as to cause the number of combustions to be less than the number of engine cycles in the same time interval with the operating state being a high rpm range wherein the rpm (n) of the engine lies above a rated rpm ($n_V$) and below an rpm ($n_A$) in a regulating range.

It has been shown that self ignitions can occur in the full load operation of the internal combustion engine. This means that the mixture, which is present in the combustion chamber, ignites automatically because of the high temperature in the combustion chamber and because of the pressure before the ignition generates an ignition spark. The tendency to self ignition is increased when the load on the engine decreases abruptly and greatly. The reduction of the load effects simultaneously an increase of the rpm. If the rpm moves into the regulating range of the ignition characteristic line, then the control so controls the engine that the rpm is reduced. This can take place via interruptions of the ignition. The interruption of the ignition has, however, no effect for revolutions wherein the mixture ignites automatically so that the rpm at first greatly increases when the load drops away. The engine is only slowly braked because of the masses in the crankcase. It was observed that the engine falls back to an rpm below the regulating range after a certain time.

To avoid the excessive increase of rpm, the internal combustion engine is so controlled in a high rpm range above the rated rpm and below the rpm in the regulating range that the number of combustions is less than the number of engine cycles in the same time interval. The rated rpm is the rpm of the engine at maximum power. It has been shown that by controlling the engine so that the number of combustions is less than the number of engine cycles in the same time interval, the tendency to self ignition can be considerably reduced above the full load rpm. If a combustion takes place for each revolution of the crankshaft, then the occurring combustion is comparatively weak because exhaust gases from the previous engine cycle can still be present in the combustion chamber. Because the engine is so controlled that a combustion does not take place for each engine cycle, the occurring combustions are very intense. If the internal combustion engine is a two-stroke engine, then the very intense combustion in the combustion chamber effects a pressure increase in the crankcase via the transfer channels of the two-stroke engine. This pressure increase effects that, in the following engine cycle, the induction of fresh combustion air or fresh mixture is deteriorated. For the following engine cycle, no mixture quantity is present in the combustion chamber which is sufficient for a self ignition. Because no combustion takes place in this engine cycle, pressure and temperature in the combustion chamber can continue to decrease so that the probability of a self ignition is reduced also for the follow-on combustions. The control of the internal combustion engine in such a manner that the number of combustions is less than the number of engine cycles in the same time interval causes that no self ignitions can occur in the high rpm range.

The same applies when the internal combustion engine is a four-stroke engine. In this case, an engine cycle includes two revolutions of the crankshaft whereas an engine cycle in a two-stroke engine includes one revolution of the crankshaft. For a four-stroke engine, it is achieved that via a very good combustion in the high rpm range, the pressure level in the combustion chamber is increased in the subsequent induction cycle so that no mixture quantity, which is sufficient for a self ignition, can be inducted. In the follow-on engine cycles, pressure and temperature have decreased so far that the probability of self ignition is significantly reduced. Self ignitions can in this way be effectively prevented also for a four-stroke engine.

Because the formation of self ignitions is prevented in the high rpm range, the rpm of the internal combustion engine can be reduced in the regulating range in the usual manner, for example, by interrupting the ignition. An uncontrolled large increase of the rpm can be avoided in that the engine is so controlled in an rpm range below the regulating range that the number of combustions is less than the number of engine cycles in the same time interval.

It has been shown that the formation of self ignitions can be effectively prevented when the engine is so controlled that in the high rpm range at most nine combustions take place for ten engine cycles. Already by preventing individual combustions, for example, by interrupting the ignition, self ignitions can be avoided. It is advantageous to suppress every seventh combustion by corresponding control of the internal combustion engine. It can, however, also be provided that the internal combustion engine is so controlled that a lower number of combustions takes place. Especially, the internal combustion engine is so controlled that, in the high rpm range, a combustion takes place at most every four engine cycles. Advantageously, the internal combustion engine is so controlled that, in the high rpm range, the number of combustions is at a ratio of 1 to 4 to 1 to 10 to the number of engine cycles. Because the combustion chamber is scavenged over three to nine engine cycles after a combustion takes place, it is ensured that also the next combustion is very good and leads to a very high pressure in the combustion chamber which prevents an adequate induction of mixture for a self ignition in the next engine cycle.

Advantageously, the number of combustions in the high rpm range is controlled in accordance with a pregiven regular pattern. Advantageously, a combustion takes place every N revolutions wherein N is a number from 4 to 10. It can also be provided that a combustion is suppressed every N revolutions wherein N is a number from 4 to 10.

It is practical to control the internal combustion engine in the regulating range so that the rpm drops. The control of the internal combustion engine in the regulating range for lowering the rpm advantageously develops after a pregiven number of engine cycles have been run through in the high rpm range. Because a pregiven number of engine cycles were run through in the high rpm range, it is ensured that the engine is subjected to a pregiven pattern of combustions and cycles wherein no combustion takes place. It is ensured that no self ignitions take place so that the internal combustion engine can be so controlled by interrupting the ignition that the rpm falls off. Advantageously, the ignition time point is shifted to a later time point in the regulating range of the internal combustion engine. An ignition time point shift can only have an effect on the rpm of the internal combustion engine when a self ignition has not taken place already in advance of the ignition. The internal combustion engine is practically so controlled in the regulating range that the number of combustions is less than the number of engine cycles in the same time interval. The number of combustions in the regulating range is especially controlled in accordance with a pattern which contains a stochastic component. It can, however, also be provided that the control of the number of combustions in the regulating range corresponds to the control of the number of combustions in the high rpm range.

Advantageously, in engine cycles wherein no combustion should take place, the ignition is interrupted. It can, however, also be provided that the number of combustions is controlled via the metering of fuel. Especially, no fuel is metered in the engine cycles wherein no combustion should take place. It can, however, also be provided that also in engine cycles wherein no combustion should take place, a small quantity of fuel for lubrication of the crankcase is supplied in a two-stroke engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
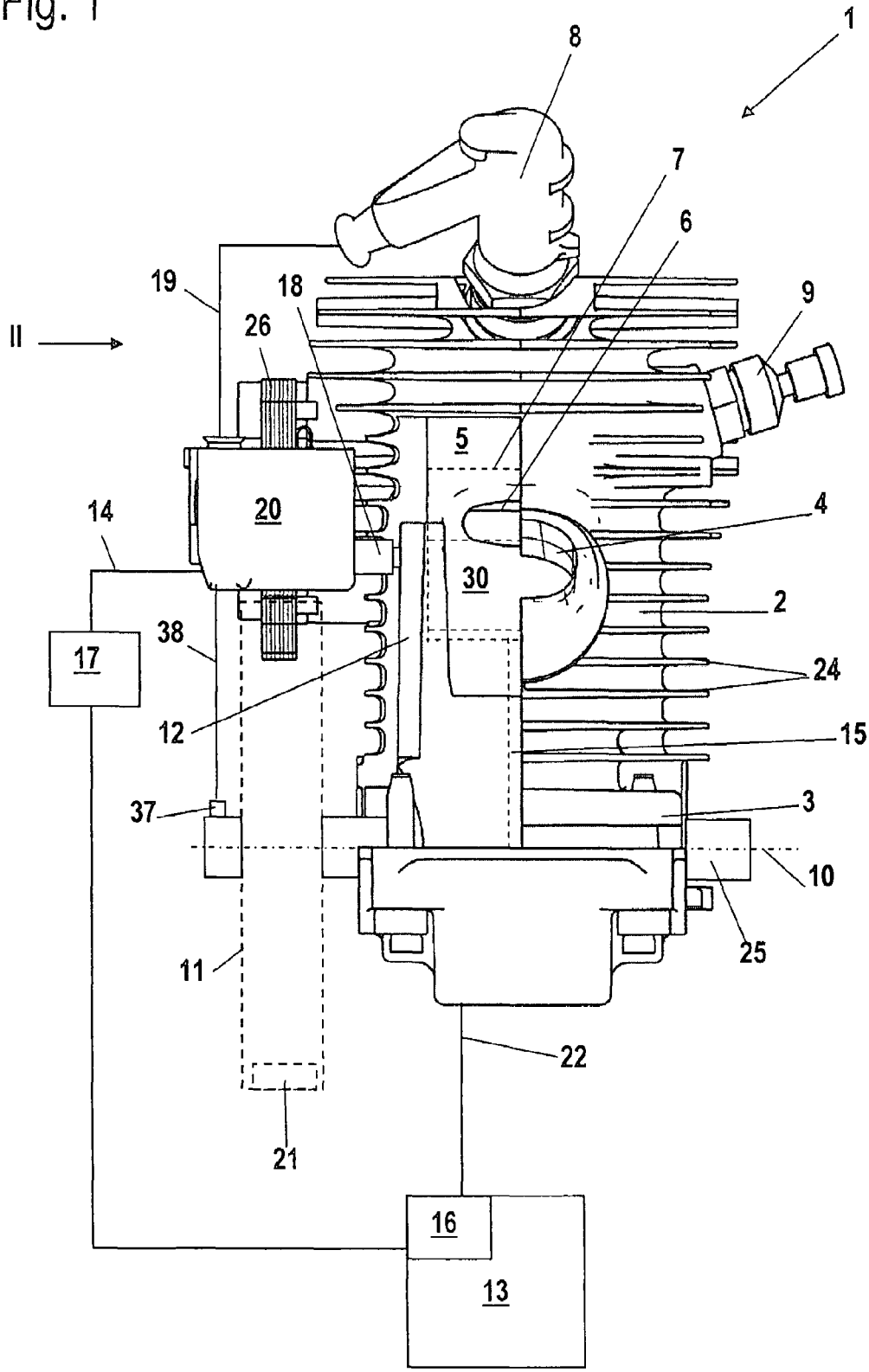
FIG. 1 is a schematic side elevation view of a two-stroke engine which draws in combustion air via a piston pocket.

The internal combustion engine shown in FIG. 1 is configured as a two-stroke engine. The two-stroke engine 1 has a cylinder 2 having cooling ribs 24 arranged on the outer surface thereof. A piston 7 is reciprocally journalled in the cylinder 2 and is shown in phantom outline. The piston 7 drives a crankshaft 25 via a connecting rod 15. The crankshaft 25 is rotatably journalled in a crankcase 3 about the crankshaft axis 10. An inlet 4 opens on the cylinder 2 via which substantially fuel-free combustion air is supplied to the two-stroke engine which is configured as a single cylinder engine.

The two-stroke engine 1 includes at least one transfer channel 12 which connects the crankcase 3 to a combustion chamber 5 in the region of bottom dead center of the piston 7. The combustion chamber 5 is delimited by the cylinder 2 and the piston 7. Two or four transfer channels 12 are provided and are arranged symmetrically with respect to a partitioning center plane centered with respect to the inlet 4. The piston 7 has a piston pocket 30 indicated in phantom outline in FIG. 1. Two piston pockets 30 can also be provided arranged on both sides of the inlet 4. The air channel can open into the transfer channels via one or several check valves, especially membrane valves. The piston pocket 30 connects the inlet 4 to the transfer channel 12 in the region of top dead center of the piston 7 so that the combustion air flows via the inlet 4 and the piston pocket 30 into the transfer channel 12 and from there into the crankcase 3. In this way, the transfer channel 12 is completely scavenged with substantially fuel-free combustion air. A decompression valve 9 can be mounted in the cylinder 2 via which the combustion chamber 5 can be vented to facilitate starting of the two-stroke engine. A spark plug 8 is mounted on the cylinder 2 and projects into the combustion chamber 5. An outlet 6 leads out from the cylinder 2 through which the exhaust gases can flow out of the combustion chamber 5.

A valve 18 is provided for metering fuel and is especially configured as an electromagnetic valve. The valve 18 can, however, also be integrated into an injection nozzle. The valve 18 is integrated in an ignition module 20. The valve 18 is controlled by a control unit, for example, a central control unit (CPU) which is arranged in the ignition module 20. The ignition module 20 controls the ignition of the spark plug 8 via a line 19. A magnet 21 is mounted on the crankshaft 25 for generating the ignition energy. More specifically, the magnet 21 is mounted on a fan wheel 11 which, in turn, is mounted on the crankshaft so as to rotate therewith.

Figure 2:
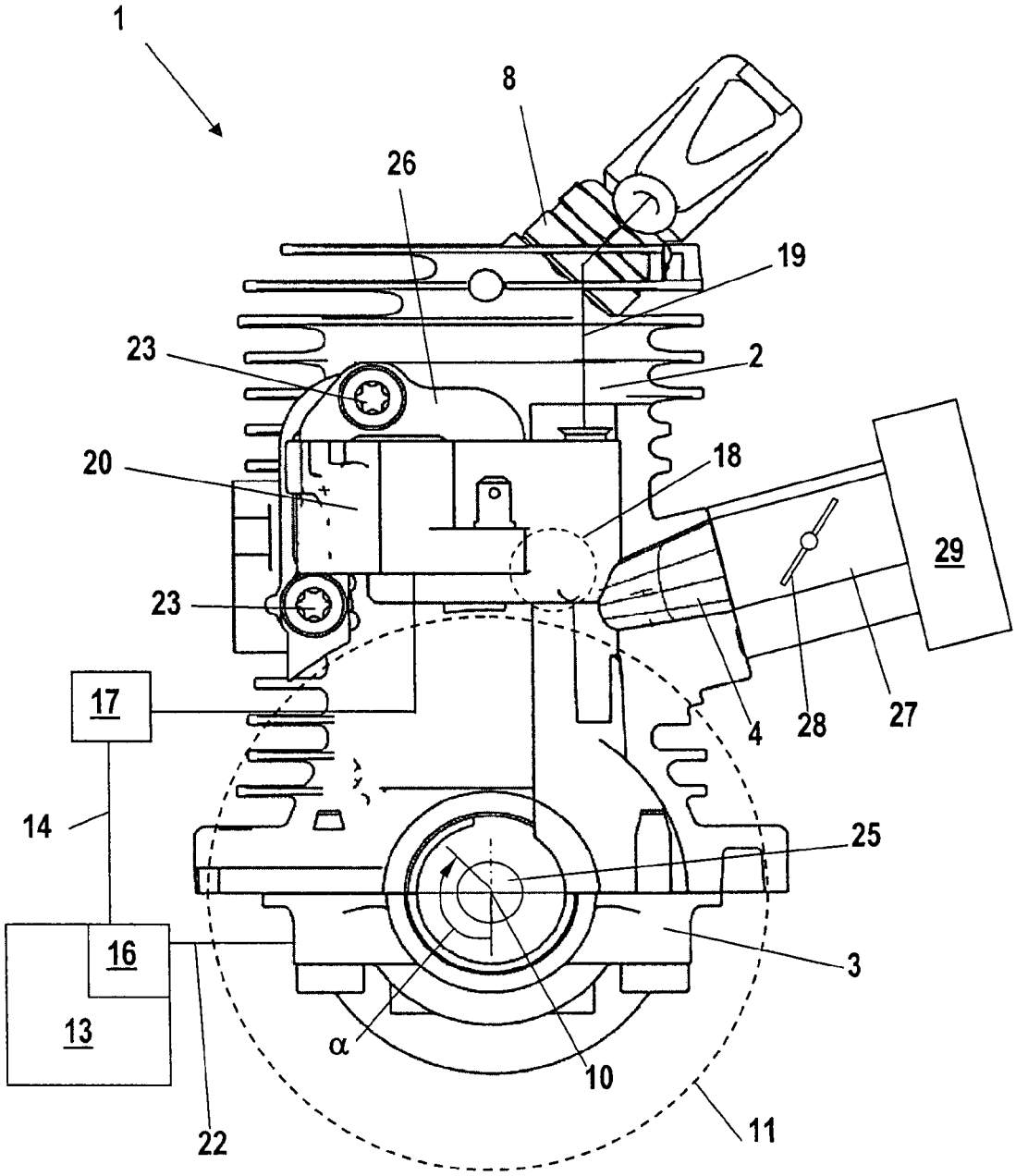
FIG. 2 is a side elevation view of the two-stroke engine of FIG. 1 viewed in the direction of arrow II in FIG. 1.

As shown in FIG. 2, a sheet metal packet 26 with an ignition coil (not shown) is mounted on the ignition module 20 at the periphery of the fan wheel 11. The magnet 21 induces a voltage in the ignition coil which generates the ignition spark in the spark plug 8. The ignition module 20 is attached to the cylinder 2 via threaded fasteners 23. However, a generator, which is mounted on the crankshaft 25, can be provided for generating the energy for the spark ignition and for the control.

The electromagnetic valve 18 is integrated on the ignition module 20 and is connected via a fuel line 14 to the fuel pump 16 mounted in the fuel tank 13. The fuel pump 16 can be configured as a membrane pump and is driven by the fluctuating crankcase pressure. For this purpose, the fuel pump 16 is connected via a pulse line 22 to the crankcase 3. The fuel pump 16 pumps the fuel from the fuel tank 13 into a fuel store 17 from where it reaches the electromagnetic valve 18. A pressure control valve can be mounted in the fuel store 17 and this valve can be connected via a return line to the fuel tank. A sensor 37 is mounted on the crankshaft 25 to detect the rpm (n). The sensor 37 is connected via a line 38 to the control mounted in the ignition module 20.

As shown in FIG. 2, the combustion air, which is supplied to the two-stroke engine 1 via the inlet 4, is drawn in by suction via a filter 29 as well as an air channel 27. In the air channel 27, a throttle flap 28 is mounted for controlling the supplied air quantity.

During operation of the two-stroke engine 1, substantially fuel-free combustion air is drawn by suction in the region of top dead center of the piston 7 from the inlet 4 via the piston window 30 and the transfer channel 12 into the crankcase 3. To lubricate the crankcase 3, the valve 18 conducts a fuel/oil mixture (which is typical for a two-stroke engine) to the combustion air at the start of the induction phase. The fuel/oil mixture is conveyed by the combustion air into the crankcase 3 and the transfer channel 12 is thereafter substantially completely filled with fuel-free air. The fuel/oil mixture and the combustion air are compressed with the downward stroke of the piston 7 in the crankcase 3. As soon as the piston 7 opens the transfer channel 12 toward the combustion chamber 5, first fuel-free air and thereafter a fuel/oil/air mixture flows from the crankcase 3 into the combustion chamber 5.

In the subsequent upward stroke of the piston 7, the mixture is compressed in the combustion chamber 5 and, controlled by the control unit integrated into the ignition module 20, is ignited by the spark plug 8. The ignited mixture expands with the combustion so that the piston 7 is pressed in the direction toward the crankcase 3. The exhaust gases flow through the outlet 6 from the combustion chamber 5 and are scavenged or expelled by the substantially fuel-free air flowing in through the transfer channel 12.

The control of the two-stroke engine 1 controls the time point at which the spark plug 8 generates an ignition spark. The control of the ignition time point ZZP takes place based on the diagram shown in FIG. 4 which shows the ignition time point ZZP in degrees crankshaft angle as a function of rpm (n). The given angular degrees are referred to the crankshaft angle ($\alpha$) shown in FIG. 2. One revolution of the crankshaft 25 corresponds to a crankshaft ($\alpha$) of 360°.

Figure 4:
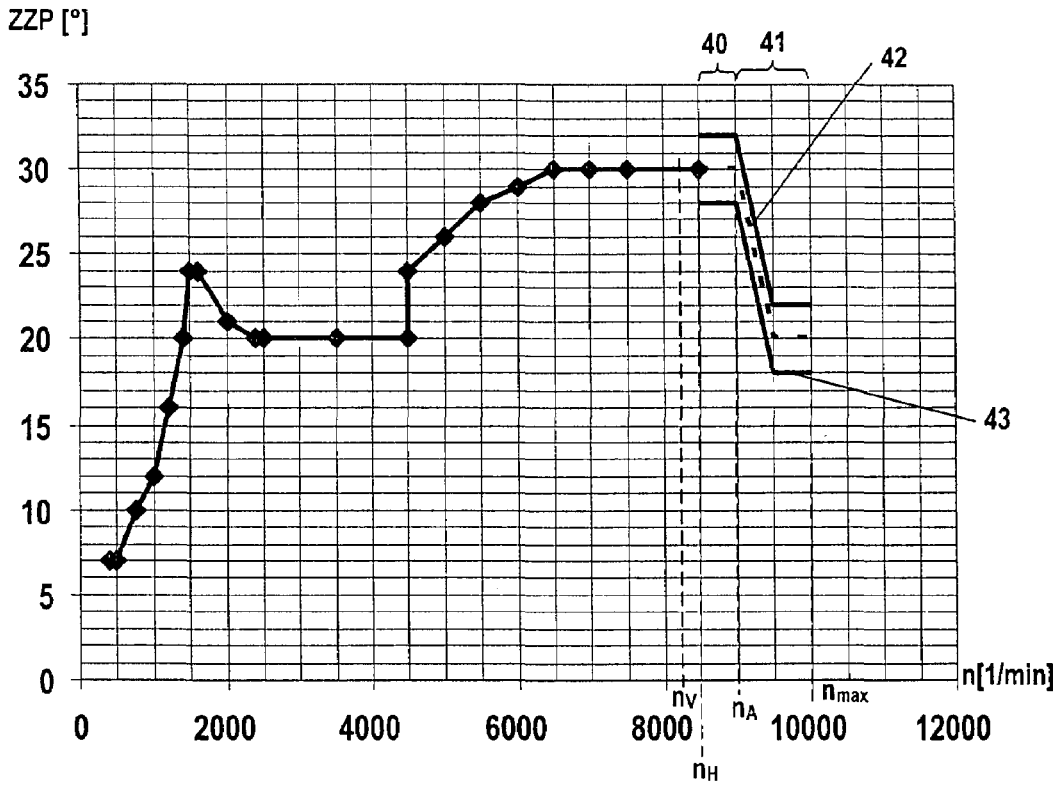
FIG. 4 is a diagram of the ignition time point as a function of engine speed (rpm)

In FIG. 4, the ignition time point ZZP is given in degrees crankshaft angle ahead of top dead center of the piston 7. As the diagram shows, the ignition time point lies approximately 30° ahead of top dead center of the piston for a rated rpm $n_V$. The ignition characteristic line has a high rpm range 40 above the rated rpm $n_V$ wherein the ignition takes place likewise at an ignition time point 30° ahead of top dead center. The rated rpm $n_V$ is the rpm of the engine at maximum power. The lower high rpm $n_H$ (that is, the lower limit of the high rpm range 40) lies at 8,500 rpm in the embodiment. A regulation range 41 extends from the high rpm range 40 wherein the ignition time point is shifted toward top dead center, that is, to later time points. With the shift of the ignition time point ZZP to later time points, the rpm (n) of the two-stroke engine 1 can be reduced. The lower regulation rpm $n_A$ (that is, the lower rpm limit of the regulation range 41) corresponds at the same time to the upper rpm of the high rpm range 40. The regulation range 41 extends from the high rpm range 40. The regulation range 41 extends up to a highest rpm $n_{max}$, up to which rpm the two-stroke engine can be driven. In the embodiment, the highest rpm $n_{max}$ is 10,000 revolutions per minute; however, the highest rpm can be greater than this amount.

The ignition time point ZZP in the high rpm range 40 and in the regulation range 41 lies between an upper tolerance band 42 and a lower tolerance band 43. The actual position of the ignition time point ZZP between the tolerance bands 42 and 43 can be dependent upon the particular two-stroke engine. The ignition time point ZZP in the high rpm range 40 and in the regulation range 41 can, however, also be dependent on additional factors, for example, on the number of combustions referred to the number of engine cycles.

Figure 7:
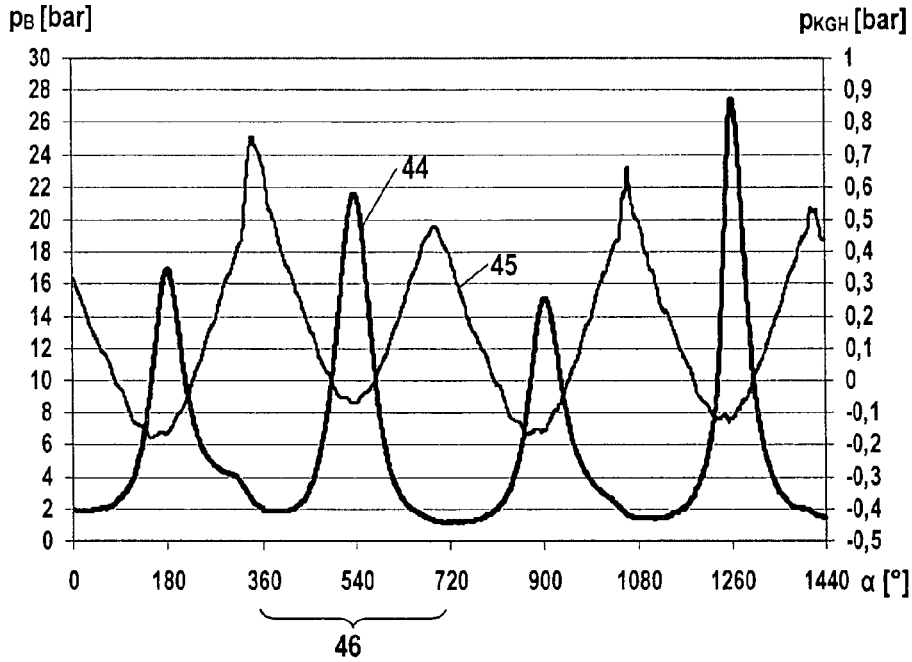
FIG. 7 is a diagram showing the course of pressure in the crankcase and in the combustion chamber plotted as a function of crankshaft angle ($\alpha$) in an internal combustion engine wherein self ignitions take place.
Figure 8:
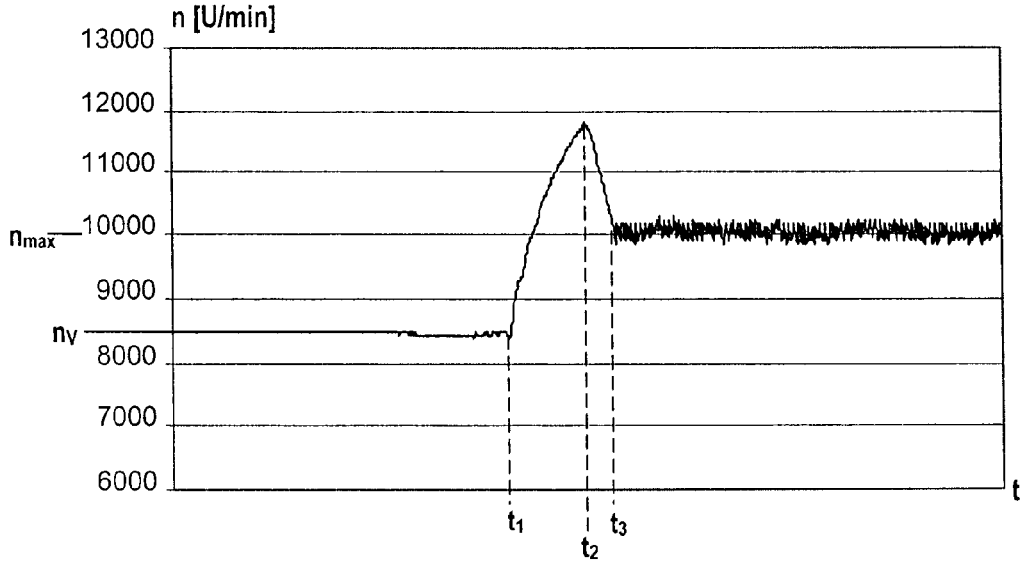
FIG. 8 is a diagram showing the course of the engine speed (rpm) as a function of time in an internal combustion engine wherein self ignitions take place.

FIGS. 7 and 8 show diagrams of a two-stroke engine 1 which is so controlled that a combustion can take place for each revolution of the crankshaft. The curve 44 shows the course of the pressure $p_B$ in the combustion chamber 5. The curve 45 indicates the course of the pressure $p_{KGH}$ in the crankcase 3. As the diagram shows, a self ignition takes place in the engine cycle 46. Here, the pressure increase in the combustion chamber 5 is shown by curve 44 and takes place earlier than in the subsequent engine cycles and in the engine cycles thereafter. The pressure development in the combustion chamber 5 fluctuates very greatly from combustion to combustion and, in the engine cycles shown, amounts to between 15 bar and barely 28 bar. The pressure $p_{KGH}$ in the crankcase 3 fluctuates irregularly.

FIG. 8 shows the course of the rpm (n) as a function of time (t). The full load rpm lies at approximately 8,500 revolutions. At time point $t_1$, the rpm (n) increases abruptly. An rpm increase of this kind can, for example, be caused in that the resistance of a work tool, which is driven by the two-stroke engine 1, drops abruptly, for example, when the cutting filament of a brushcutter tears. Up to the time point $t_2$, the rpm (n) increases to a value just under 12,000 revolutions per minute. Only thereafter does the drop in rpm take place. Starting from the time point $t_3$, the rpm fluctuates about a value of approximately 10,000 revolutions per minute. The rpm drop between the time points $t_2$ and $t_3$ can, for example, be caused by the resistance of the mass, which is moved by the engine, or by a renewed engagement of the work tool. After time point $t_3$, the control controls the rpm (n) of the two-stroke engine 1, for example, by shifting the ignition time point ZZP when a limit rpm is exceeded.

Figure 5:
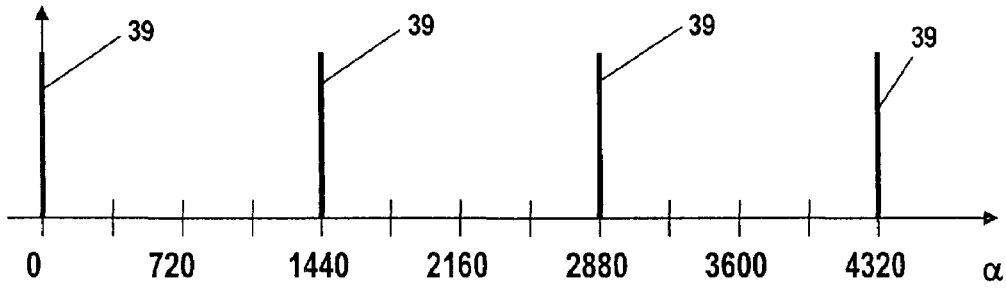
FIGS. 5 and 6 are diagrams of the combustion as a function of the crankshaft angle ($\alpha$)

To avoid an abrupt increase in rpm after the time point $t_1$, the combustions of the two-stroke engine 1 are controlled in the high rpm range as shown in FIG. 5. In FIG. 5, combustions 39 are shown referred to the crankshaft angle (α). As FIG. 5 shows, the two-stroke engine 1 is so controlled that a combustion 39 only occurs every four revolutions, that is, every 1,440° crankshaft angle (α). For the two-stroke engine shown in FIG. 1, the control of the number of combustions can take place by interrupting the metering of fuel. Accordingly, fuel is metered only in the engine cycles during which a combustion is to take place. Additionally, or alternatively, the ignition can be interrupted. Self ignitions occur only sporadically in the high rpm range 40. For this reason, by interruptions of the ignition, a pregiven pattern of engine cycles wherein a combustion takes place to those engine cycles wherein no combustion takes place, can be impressed. The ratio of combustions during which a combustion takes place to engine cycles wherein no combustion takes place amounts to 1 to 4 to 1 to 10.

Figure 6:
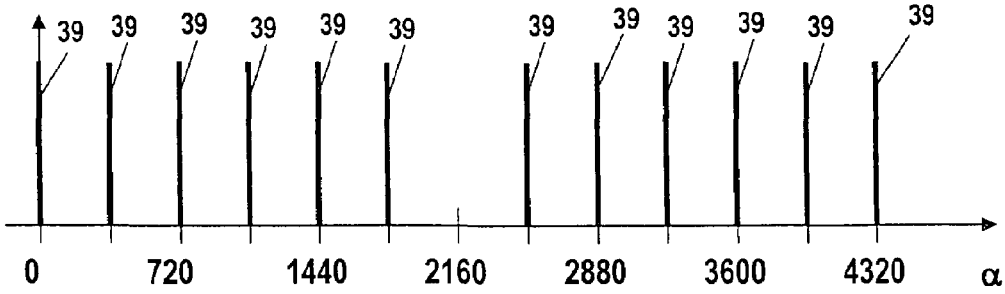

It can also be provided to control the combustions of the two-stroke engine 1 in the high rpm range 40 as shown in the diagram of FIG. 6. In FIG. 6, the combustions 39 are likewise shown referred to the crankshaft angle (α). The two-stroke engine 1 is so controlled that six sequential combustions 39 take place and in every seventh engine cycle, that is, every seventh revolution of the crankshaft 25, the combustion is interrupted, for example, by interrupting the ignition or in that no fuel is metered to the two-stroke engine 1.

Figure 9:
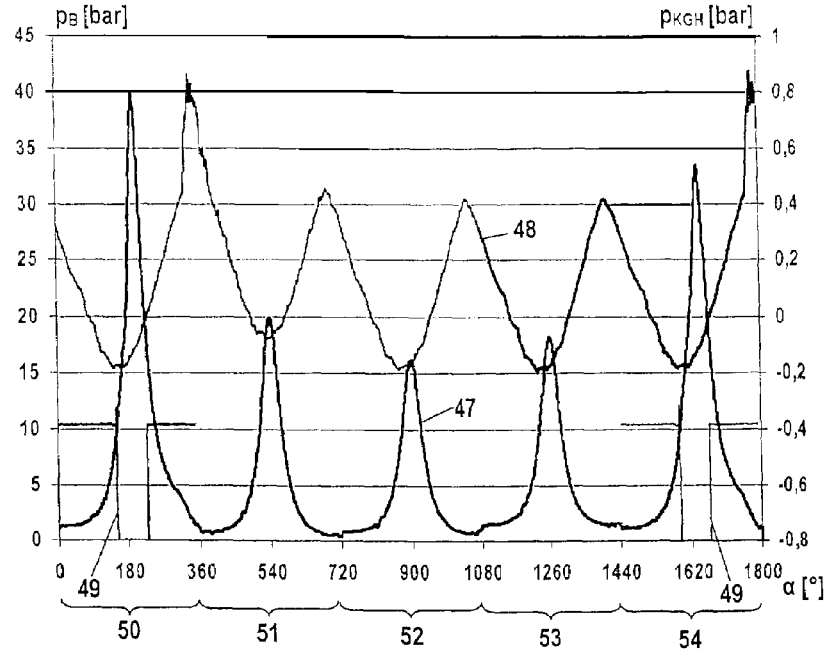
FIG. 9 shows the course of the pressure in the crankcase and in the combustion chamber as a function of crankshaft angle ($\alpha$) in an internal combustion engine wherein the formation of self ignitions is avoided.

FIG. 9 shows the course of the pressure $p_{KGH}$, $p_B$ in the crankcase 3 and in the combustion chamber 5 in a two-stroke engine 1 wherein the two-stroke engine 1 is so controlled in the high rpm range 40 that a combustion 39 takes place every four revolutions of the crankshaft 25, that is, every four engine cycles. For this purpose, an ignition takes place only every four revolutions of the crankshaft 25. The ignition is shown in FIG. 9 by the curve 49. The crankcase pressure $p_{KGH}$ is shown by the curve 48 and the combustion chamber pressure $p_B$ by the curve 47.

An ignition takes place in the first engine cycle 50. The combustion taking place thereafter in the combustion chamber 5 leads to a very great pressure increase to 40 bar. This very intense combustion causes an intense increase of the crankcase pressure $p_{KGH}$ to over 0.8 bar via the transfer channels 12. Because of this very great pressure increase in the crankcase 3, the pressure $p_{KGH}$ in the crankcase 3 drops only slightly below the ambient pressure in the subsequent engine cycle 51 which is identified in the diagram by "0". Because of the high pressure $p_{KGH}$ in the crankcase 3, only small amounts of fuel are inducted into the crankcase 3. In the engine cycle 50, a substantial combustion of the fuel in the combustion chamber 5 has taken place. The exhaust gases in the combustion chamber 5 are scavenged only incompletely in the following cycle. In the engine cycle 51, no sufficient quantity of fresh mixture is present in the combustion chamber 5 so that no self ignition can adjust. In the subsequent engine cycle 52, only a small amount of fresh mixture likewise reaches the combustion chamber 5 because the induction of fresh mixture into the crankcase 3 was hindered in the engine cycle 51 because of the high pressure in the crankcase 3. Therefore, no self ignition can take place in engine cycle 52. In the engine cycle 53, the combustion chamber 5 is again scavenged with a fresh mixture. In the engine cycle 53, also no self ignition can take place because the combustion chamber 3 was cooled down by the multiple scavengings and the pressure could also decrease. An ignition of the mixture takes place again in the fifth engine cycle 54. A strong good combustion takes place with a pressure increase to almost 35 bar. The strong combustion results because the mixture present in the combustion chamber 5 is substantially of exhaust gas because of the multiple scavengings of the combustion chamber 5 in the previous engine cycles 51 to 53. The intense pressure increase in the combustion chamber 5 transfers into the crankcase 3 and leads to a great increase of the crankcase pressure $p_{KGH}$ to above 0.8 bar in the crankcase 3. This high pressure in the crankcase 3 hinders the subsequent induction of fresh mixture so that self ignitions are also avoided for the following engine cycles.

Figure 10:
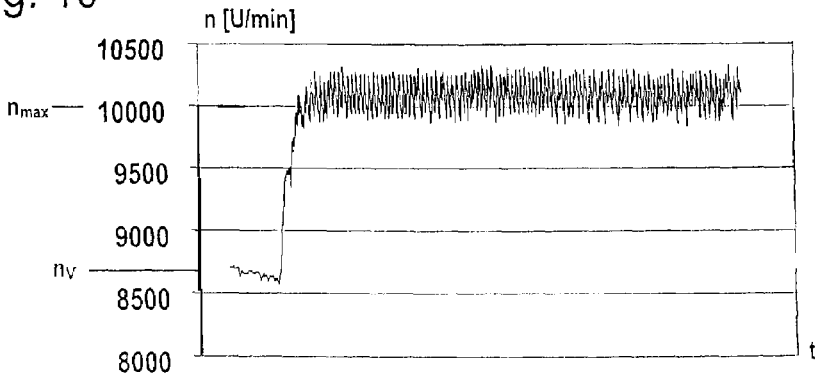
FIG. 10 shows the course of the engine rpm as a function of time in an internal combustion engine wherein the formation of self ignitions is avoided; and, FIG. 11 is a flowchart of the method for controlling an internal combustion engine.

In FIG. 10, the course of the rpm (n) is shown as a function of time (t) for a two-stroke engine 1 wherein the number of combustions in the high rpm range 40 is controlled as shown in FIG. 8. As shown in FIG. 10, the rpm (n) at first increases greatly from the full load rpm $n_V$; however, the rpm increase takes place only up to the highest rpm $n_{max}$ which lies at approximately 10,000 revolutions per minute in the embodiment. The rpm then fluctuates about the highest rpm $n_{max}$. A sudden increase of the rpm (n) to an rpm (n) considerably above the highest rpm $n_{max}$, as it is shown in FIG. 8, is avoided. When reaching the lower high rpm $n_H$, the two-stroke engine 1 is already so controlled that a combustion can take place only maximally every four revolutions of the crankshaft 25. In this way, self ignitions are avoided. As soon as the rpm (n) reaches the lower regulating rpm $n_A$, the control begins to control the two-stroke engine 1 so that the rpm (n) falls off. This can take place via interruptions of the ignition, by shifting the ignition time point ZZP and/or by reducing or interrupting the metering of fuel to the two-stroke engine 1. In this way, the rpm (n) of the two-stroke engine 1 is controlled to the highest rpm $n_{max}$.

Figure 11:
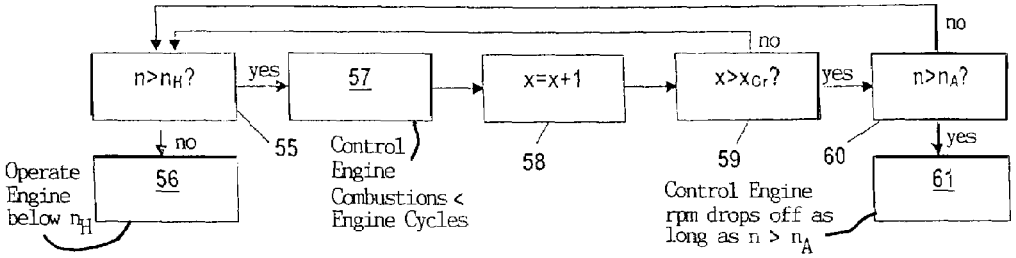

A flowchart for a method for operating an internal combustion engine is shown in FIG. 11. In the method step 55, a check is made as to whether the engine rpm (n) is greater than the lower high rpm $n_H$. If this is not the case, the engine is operated below the lower high rpm $n_H$ in method step 56 in the usual manner. If the rpm (n) is greater than the lower high rpm $n_H$, then, in method step 57, the internal combustion engine is so controlled that the number of combustions is less than the number of engine cycles. The two-stroke engine 1 is then especially so controlled that a combustion takes place only every four to every ten engine cycles. The control can also take place so that each fourth to tenth combustion is suppressed, for example, by interrupting the ignition. For each engine cycle, the number (x) of the engine cycles is increased by one in method step 58. Thereafter, in method step 59, a check is made as to whether the number of engine cycles is greater than a limit value $x_{Gr}$. As long as the number (x) of engine cycles is less than the limit number $x_{Gr}$, the loop repeats starting with method step 55. Each time a check is made as to whether the instantaneous rpm (n) is still greater than the lower high rpm $n_H$. As soon as the instantaneous rpm (n) drops below the lower high rpm $n_H$, the number (x) of engine cycles is reset to zero. If the number (x) of engine cycles is greater than the limit number $x_{Gr}$, a check is made in method step 60 as to whether the instantaneous rpm (n) is greater than the lower regulating rpm $n_A$. If this is not the case, the loop is run through again starting from method step 55. If the instantaneous rpm (n) is greater than the lower regulating rpm $n_A$, then, in method step 61, the internal combustion engine is so controlled that the rpm drops off as long as the rpm (n) is greater than the lower regulating rpm $n_A$.

Because at first a certain number of engine cycles is run through during which the internal combustion engine is so controlled that the number of combustions is less than the number of engine cycles in the same time span, it is ensured that combustions take place still only in the imposed pattern and no self ignitions can take place any more. It can also be provided that in the regulating range 41 too, the internal combustion engine is so controlled that a combustion does not take place in each engine cycle. The number of combustions in the regulating range can then be controlled in accordance with a pattern which contains a stochastic component. However, it can also be provided that the control in the regulating range of the control corresponds to the number of combustions in the high rpm range. In the high rpm range and in the regulating range, the control of the combustions can take place in accordance with the same pattern.

Figure 3:
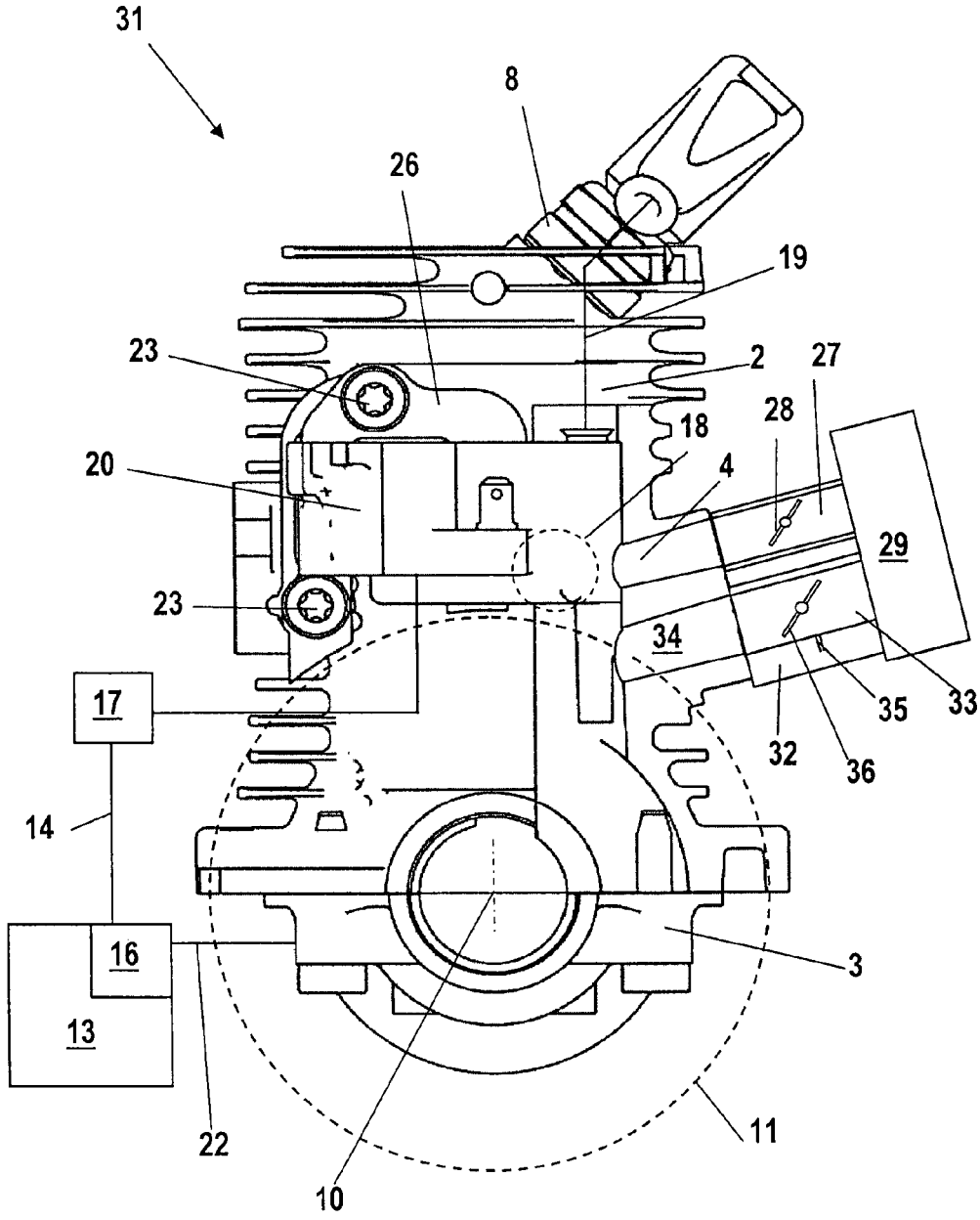
FIG. 3 is a schematic side elevation view of a two-stroke engine having a scavenging-advance function.

An embodiment of a single cylinder two-stroke engine 31 is shown in FIG. 3. The same reference numerals identify the same components as in FIGS. 1 and 2. The two-stroke engine 31 has an inlet 4 for substantially fuel-free air as well as a mixture inlet 34. A carburetor 32 is shown schematically in FIG. 3 and is mounted at the mixture inlet 34. A throttling device is mounted in the carburetor 32 and is shown here as a pivotally supported throttle flap 36. A fuel opening 35 opens into the mixture channel 33 in the region of the throttle flap 36. The mixture channel 33 is formed in the carburetor 32 and the fuel opening 35 supplies fuel to the mixture channel 33. At least a portion of the fuel is supplied via the carburetor 32 in the full load operation of the two-stroke engine 31. During idle operation, the fuel metering takes place via the valve 18 integrated into the ignition module 20. In this way, a lubrication of the crankcase 3 during full load operation can be achieved in a simple manner. At the same time, a sufficient fuel supply is ensured. It can, however, also be provided that the total fuel to be supplied to the two-stroke engine 1 is supplied via the carburetor 32. A valve 18 can then be omitted. For an internal combustion engine wherein the total fuel quantity to be supplied is supplied via a carburetor, the number of combustions can only be controlled via the interruption of the ignition. In internal combustion engines wherein the fuel metering takes place only via a carburetor 32, not only the induction of additional combustion air but also the further induction of fuel is hindered by the increased crankcase pressure $p_{KGH}$ shown for a good combustion as in FIG. 9 in the engine cycles 50 and 54. In this way, a self ignition in the subsequent cycle can be especially effectively avoided.

The described method for preventing self ignition and for limiting the rpm of an internal combustion engine is also applicable in a four-stroke engine.

In addition to the described methods for operating an internal combustion engine, all of the methods disclosed in United States patent application publication US 2006/0157006 A1 can be applied.

It is understood that the foregoing description is that of the preferred embodiments of the invention and that various changes and modifications may be made thereto without departing from the spirit and scope of the invention as defined in the appended claims.

What is claimed is:

1. A method of operating an internal combustion engine, the engine including: a cylinder; a piston mounted in said cylinder to undergo a reciprocating movement along a stroke path between top dead center and bottom dead center during the operation of said engine; said cylinder and said piston conjointly delimiting a combustion chamber; a crankcase connected to said cylinder; a crankshaft rotatably mounted in said crankcase; said piston being connected to said crankshaft for imparting rotational movement to said crankshaft; a device for metering fuel to said engine and a device for supplying air to said engine; an ignition unit for igniting an air/fuel mixture in said combustion chamber; and, a control unit controlling the metering of said fuel and the time point (ZZP) of the ignition of said mixture in said combustion chamber; said engine having a rated rpm ($n_V$) which is the rpm at maximum power; said engine having an rpm (n) which can vary during operation thereof and having a high-rpm range wherein the rpm (n) of said engine lies above said rated rpm ($n_v$); and, said engine having a regulation range wherein the rpm lies above the rpm in said high-rpm range and said regulating range extending up to a maximum rpm ($n_{max}$); the method comprising the step of controlling said engine in said high-rpm range so as to cause the number of combustions to be less than the number of engine cycles in the same time interval; and, in said regulating range of said engine, shifting said ignition time point (ZZP) to a later time point.

2. The method of claim 1, wherein said engine is so controlled that at most nine combustions for ten engine cycles take place in said high rpm range.

3. The method of claim 2, wherein said engine is so controlled that at most one combustion takes place every four engine cycles in said high rpm range.

4. The method of claim 3, wherein said engine is so controlled that the number of combustions to the number of engine cycles is in a ratio range of 1 to 4 to 1 to 10 in said high rpm range.

5. The method of claim 1, wherein said engine is so controlled in said regulating range that said rpm (n) falls off.

6. The method of claim 5, wherein said control begins to reduce said rpm (n) in said regulating range after a pregiven number (x) of engine cycles have been run through in said high rpm range.

7. The method of claim 5, wherein said engine is so controlled in said regulating range that the number of combustions is less than the number (x) of said engine cycles in the same time interval.

8. The method of claim 5, wherein the control of the number of combustions in said regulating range corresponds to the control of the number of combustions in said high rpm range.

9. The method of claim 1, wherein the ignition is interrupted in engine cycles wherein no combustions should take place.

10. The method of claim 1, wherein the number of combustions is controlled via the metering of the fuel.

* * * * *